US005365214A

United States Patent [19]

Angott et al.

[11] Patent Number: 5,365,214

[45] Date of Patent: Nov. 15, 1994

[54] MUSICAL WIRELESS ALERTING SYSTEM

[75] Inventors: Paul G. Angott, Troy; Gregory G. Kilby, Plymouth; Thomas G. Xydis, Ann Arbor, all of Mich.

[73] Assignee: Dimango Products Corporation, Brighton, Mich.

[21] Appl. No.: 934,363

[22] Filed: Aug. 24, 1992

[51] Int. Cl.[5] ..... G08B 3/00

[52] U.S. Cl. ..... 340/328; 340/384.5; 340/691; 340/825.36

[58] Field of Search ..... 340/326, 328, 330, 691, 340/825.3, 825.34, 825.36, 825.45, 384.5

[56] References Cited

U.S. PATENT DOCUMENTS

| | | | |
|---|---|---|---|
| 4,326,276 | 4/1982 | Scott, Jr. | 368/10 |
| 4,641,127 | 2/1987 | Hogan et al. | 379/40 |
| 4,777,474 | 10/1988 | Clayton | 340/539 |
| 5,014,039 | 5/1991 | Zelenka | 340/328 X |

*Primary Examiner*—Jeffery A. Hofsass

*Attorney, Agent, or Firm*—Reising, Ethington, Barnard, Perry & Milton

[57] ABSTRACT

The musical wireless alerting system includes several detectors (12) which transmit rf signals to a common receiver (14). The detectors (12) include manual switches thereon to allow manual selection of a song or melody. The selection is coded in the form of an audio code which is transmitted to the receiver (14). The receiver (14) detects any rf transmissions and verifies that the received transmissions are identifiable with the receiver (14). Upon verification, the receiver reads the audio code and compares same to a plurality of stored songs or tones within memory for transmission to a speaker which plays the tone or song. Each of the detectors (14) may sense different predefined conditions and indicate different audible indications to be played. The detectors may sense conditions such as opening of the door or depression of a door bell.

31 Claims, 4 Drawing Sheets

MUSICAL WIRELESS ALERTING SYSTEM

TECHNICAL FIELD

The invention relates to security and alerting systems which include a single receiver receiving radio frequency transmissions from a plurality of transmitters which sense conditions, and which receivers audibly indicate the occurrence of the conditions.

BACKGROUND OF THE INVENTION

Security systems are commonly known in which a transmitter is connected to an entrance door which produces an audible indication or alarm when the door is opened. Furthermore, audible indication has been utilized to indicated conditions such as door bells.

U.S. Pat. No. 4,641,127, issued Feb. 3, 1987 in the name of Hogan et al discloses a security and fire protection system which utilizes a plurality of detection transmitter units which transmit unique signals corresponding to the specific type of condition. Such transmitter units may be detect the conditions of smoke, intrusion, or heat. A receiver alarm unit receives and decodes the signals produced by the detection transmitter units and produces an alarm signal indicating which type of detection transmitter has been actuated.

U.S. Pat. No. 4,777,474, issued Oct. 11, 1988 in the name of Clayton, discloses an alarm system for the hearing impaired which utilizes a base station provided with a radio transmitter for transmitting alarm signals, such as telephone, smoke/fire or door bell to a portable unit equipped with a receiver. The base station comprises a ring detect logic, smoke/fire alarm logic, front door logic, and burglar alarm logic hardwired to a telephone line, smoke/fire alarm, door bell push button, and burglar alarm, respectively. The logic circuits generate signals indicative of the alarm condition and are hardwired to an audio signal generator. The resulting audio signal generated by the audio signal generator is coupled to a low power FM transmitter for transmission to the portable receiver unit. An FM receiver receives the transmitted radio frequency signal via an antenna. The FM demodulator recovers the audio signal from the FM carrier and applies it to an ear phone via an audio preamplifier and audio driver. The patent teaches a wireless system comprising transmitter and receiver pairs wherein the receiver is capable of audibly indicating specific household conditions received from the transmitter via an rf signal created by an audio generator and logic circuitry that corresponds to the particular household condition.

U.S. Pat. No. 4,326,276, issued Apr. 20, 1982 in the name of Scott, Jr. discloses a musical door chime which is connected to the front and rear push buttons of a household. The chime is capable of playing a combination of musical tones when a door bell push button is actuated. The door bell push buttons are hardwired to a microprocessor. The musical tones which are played may be selected by a key board connected to a microprocessor. The musical door chime is capable of sounding a first musical tone when the front door bell push button is actuated and a second two-note musical tone when the rear door bell push button is actuated, and a third signal musical tone when the side door bell push button is actuated. However, the patent requires hardwiring between microprocessor and the push buttons which creates difficulty in installation.

SUMMARY OF THE INVENTION

The invention is an alerting assembly for producing audible indication of predefined conditions. The assembly comprises detector means for detecting a predefined condition and for producing and transmitting an electromagnetic alert signal indicative thereof. Audio means receives the electromagnetic alert signal and produces one of several audible indications representative of the predefined condition. The assembly is characterized by the detector means including audible selection means for manual selection of one of the plurality of audio codes representative of different audible indications produced by the audio means, and transmitter means for receiving and transmitting the selected audio code upon detection of the predefined condition to the audio means.

The invention is also characterized by the detector means by including selection means for selecting one of the plurality of audio indications by manual selection of an audio code included in the alert signal transmitted to the audio means.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
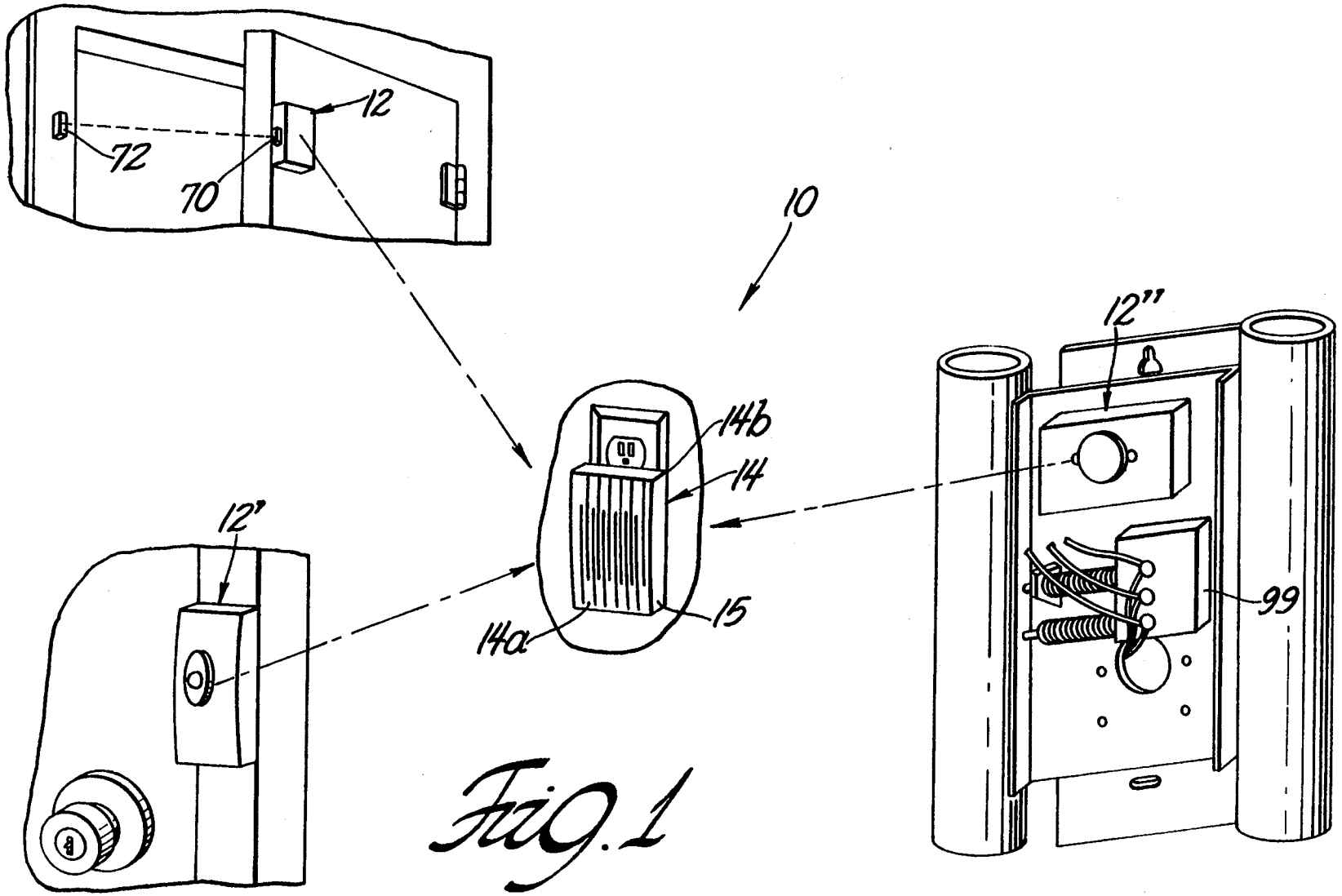
FIG. 1 is a general schematic representation of the assembly.

An alerting assembly for producing audible indication of predefined conditions is generally illustrated at 10 in FIG. 1. The assembly 10 is capable of detecting several different predefined conditions and audibly indicating each condition by selectable and different tones or melodies. Selection of the tone or melodies may be accomplished by the user for each condition.

The assembly 10 includes a plurality of detector means 12 for detecting a predefined condition and for producing and transmitting an electromagnetic alert signal, namely radio frequency, indicative thereof. The assembly 10 also includes audio means 14 for receiving the rf alert signal and for producing one of several audible indications representative of the detection of the predefined condition. A plurality of detector means 12 communicate with the audio means 14 via a UHF radio link. The audio means 14 is capable of playing any of eight sounds or songs as selected by each detector means. It is to be understood that more or less songs may be specified and used depending upon the amount of digital coding. The alert signal comprises at least an audio code and an identification code. The audio means 14 must receive valid audio codes and identification codes in the alert signal for validation thereof and production of the audible indications. The audio means 14 will compare the identification code with a system code stored within the audio means 14 to insure that the transmitting detector means 12 is appropriately related to the receiving audio means 14.

More specifically, the alert signal consist of six words, two of which must be received correctly to cause the audio means 14 to respond thereto. The alert signal consists of a data word comprising a sync bit, a five bit identification code, a three bit audio code, and a parity bit. The sync bit is a unique symbol so that the audio means 14 can easily recognize the beginning of the word. The identification code is used to identify a specific detector means 12 with a specific audio means 14. It can be user programmed, as subsequently discussed. The audio code is bit coded and instructs the audio means 14 which song or melody to play. The audio means 14 stores the song assignment, i.e., the actual song or sound which corresponds to a specific code. Exemplary of such audio codes and song assignments include the following: code=0 dong tone; code=1 ding dong tones; code=2 West Minster Chimes melody; code=3 My Country Tis Of Thee melody; code=4 Hail Hail The Gangs All Here melody; code=5 The Twelve Days Of Christmas melody; code=6 single phone ring; and code=7 siren. The parity bit must match for the audio means 14 to conclude that it has received a valid word. Parity is computed over the data bits only as is commonly known in the art. As can be understood, any melodies or tones can be programmed into the audio means 14.

The assembly 10 includes a plurality of different types of detector means 12 which detect different predefined conditions and send specified and selectable audio codes based thereon. In general, each of the detector means 12 includes condition sensing means 16 for sensing the occurrence of a predefined condition and for producing a detection signal. The detector means 12 also includes transmitter means 18 for transmitting the alert signal via radio waves. The detector means 12 includes audible selection means 20 for manual selection of one of the plurality of audio codes representative of different audio indications produced by the audio means 14. The audible selection means 20 includes manual activation means 22 for responding to manual actuation by the user for setting the audio code. The audio selection means 20 also comprises setting means 24 for responding to the manual activation means 22 to increment the audio codes to set the selection of the audio code. The setting means 24 encodes the audio code for transmission by the transmitter means 18. Coding means 26 establishes the identification code. Both the identification code and the audio code are combined in the alert signal and transmitted by the transmitter means 18.

The condition sensing means 16 may be any type of sensor as commonly known in the art for detecting a plurality of various conditions, such as door opening, door bell depression, telephone ringing, etc. Specific designs of the detector means 12 will be subsequently discussed.

The audio means 14 receives the alert signal and responds thereto. The audio means 14 includes decoding means 28 for receiving the rf alert signal and for ensuring the rf signal is associated with the audio means 14. The decoding means 28 detects the alert signal and determines if both an audio code and an identification code is transmitted. The received alert signal is converted into a digital data signal which is communicated to processor means 30. The processor means 30 in turn verifies the format of the transmitted signal and compares the identification code with a stored system code. Identification means 32 stores the system code which is related to the identification code. The identification means 32 allows manual setting of the system code. The processor means 30 makes the comparison to ensure that the identification code and the system code are equivalent for further processing. If the codes are not equivalent, the audio means 14 ignores the transmission.

The processor means 30 also uses the audio code to obtain from internal memory 31 the necessary signals to produce the selected audible indication. The memory 31 stores the melodies or tone formats along with a song code equivalent to the audio code for identification of the proper tone format. The processor means 30 produces an audio signal based on one of the melodies or tone formats obtained from memory, which is received by synthesizer means 34 to produce the audible indication. The synthesizer means 34 is a simplified synthesizer to produce the audible melody, song or tone. The audio means 14 includes power supply means 36 which is capable of receiving ac power, i.e., from a standard wall jack, and for converting same to dc power as required by the remainder of the audio means 14.

Therefore, the audio means 14 merely responds to rf transmissions by the detector means 12 and determines the audio indication to be played based on the coding from the detector means 12. It is to be understood that each detector means 12 may be audibly coded differently or similarly merely dependent upon the manual coding established thereon. Therefore, one tone or melody may be established for one predefined condition, while another tone or melody can be established for a different condition to allow the occupant to audibly determine which condition is occurring, or one tone can be associated with an area or location.

The audio means 14 may be powered and moved to any room within the range of the detector means 12. Several audio means 14 may be utilized for placement in various locations all within range of the detector means 12.

The audio means 14 is supported within housing means 15. The housing means 14 includes a generally rectangular plastic, hollow form for enclosing the circuitry of the audio means 14. A front face **14*a* include a plurality of slits therethrough to allow transmission of the sound signals. On an opposing rear face 14*b*, a pair of contacts or plug project therefrom for receiving ac power and supplying same to the power supply means 36. Each detector means 12 includes similar housing structure as illustrated in FIG. 1**, along with means for connecting same to the selected structure.

Figure 2:
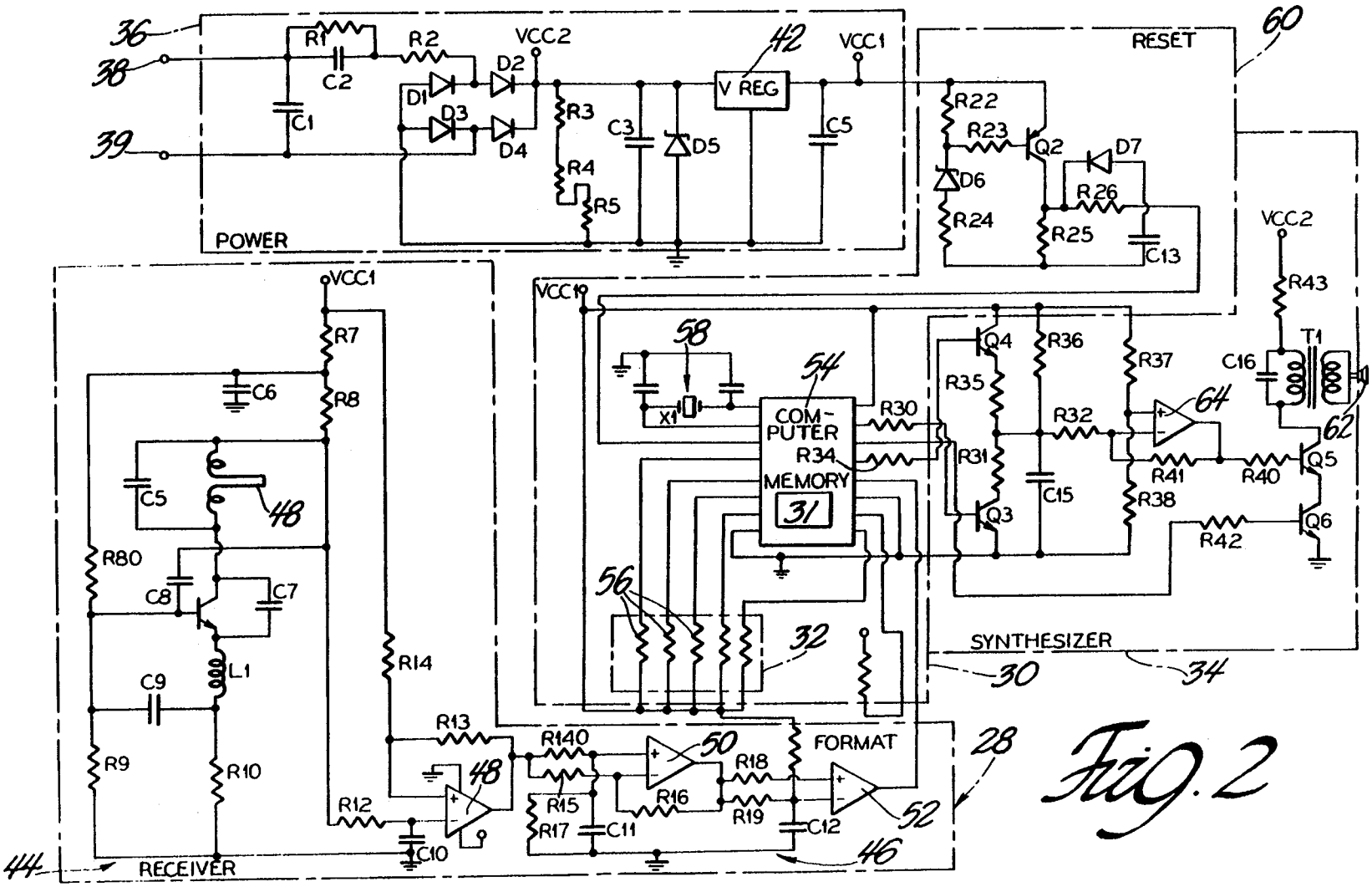
FIG. 2 is a circuit diagram of the audio means.
Figure 3:
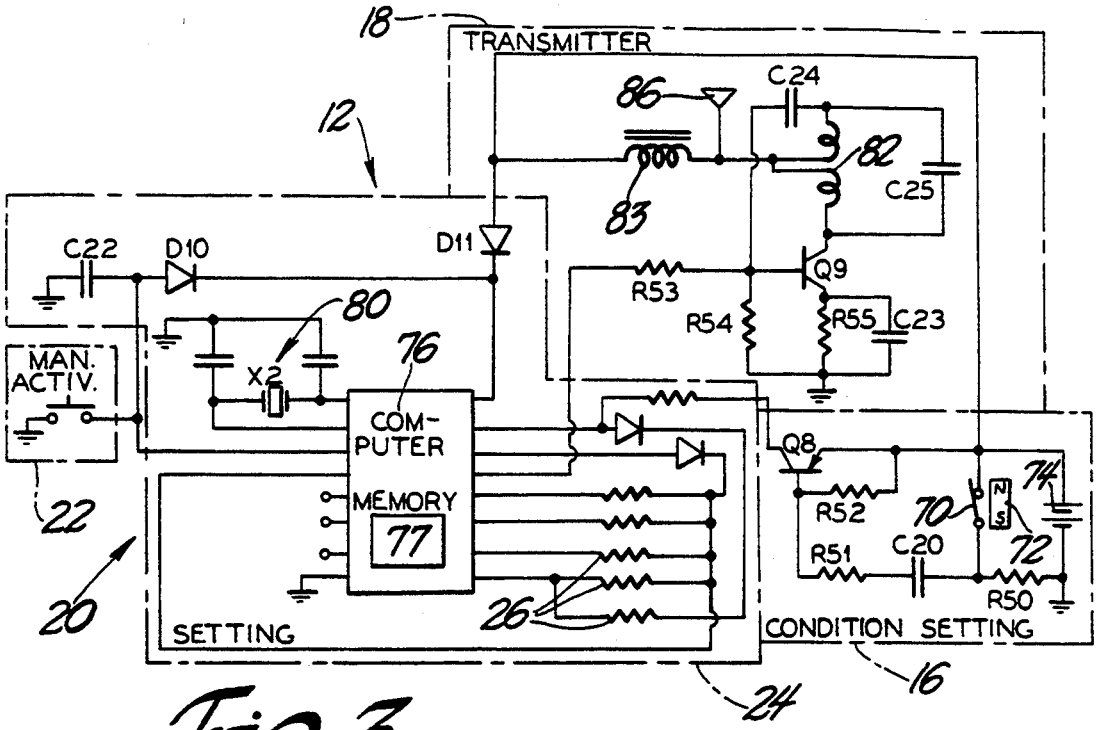
FIG. 3 is a circuit diagram of the entrance detector means.

The audio means 14 is specifically illustrated in FIG. 2. The audio means 14 receives the rf alert signal from any of the detector means 12, decodes the transmission into the identification code and audio code compares the codes with the house code. If a match is observed, then the audio means 14 decodes the audio code and plays the appropriate song or melody.

The power supply means 36 includes a pair of ac prongs 38, 39 which are adapted to be inserted in a plug receptacle, commonly 120 volts ac 60 Hz. A capacitor C1 is connected across the prongs 38, 39, and a series capacitor C2 connected to the first prong 38 with a parallel resistor R1 thereacross. A resistor R2 is connected to the R1/C2 juncture. Four diodes D1–D4 are connected, in series and in parallel pairs, with the resistor R2 connected between the series diodes D1, D2. The ground prong 39 is connected between the second pairs D3, D4. The juncture of the diodes D2, D4 is connected to a series of three resistors R3–R5 to ground. A parallel capacitor C3 and zener diode D5 are connected parallel therewith. A voltage regulator 42 is connected with an output capacitor C4 connected thereto. The output of the voltage regulator 42 produces a 5 volt dc output at VCC1. The power supply means 36 also produces a 25 volt dc output for the synthesizer means 34.

The decoding means 28 includes receiver means 44 for receiving the rf transmission, and format means 46 to provide the data to the processor means 30. The receiver means 44 includes a coil antenna 48 for detecting rf signals. The coil 48 is connected in parallel with capacitor C5. Power is received through a resistor R7 in series with resistor R8 to a terminal of the coil 48. A capacitor C6 is connected to ground between the resistors R7, R8. A UHF amplifier transistor Q1 is connected with its emitter and collector across the capacitor C7. The base of the transistor Q1 is controlled through the capacitor C8 and resistor R8. Connected to the emitter of the transistor Q1 is a choke L1, also connected to both the capacitor C9 and resistor R10. Capacitor C9 is also connected to resistor R9 to ground. Capacitor C8 is also connected through resistor R12 to the noninverting input of an operational amplifier 48. A capacitor C10 connects the noninverting input to ground. The inverting input of the operational amplifier 48 is connected through feedback resistor R13 and through resistor R14 to VCC power. The output of the operational amplifier 48 is connected to a pair of parallel resistors R14, R15 to noninverting and inverting input of the second operational amplifier 50, respectively. The operational amplifier 50 circuitry forms a selfbiasing detector circuit which amplifies small signals while ignoring large DC bias. The operational amplifier 50 has a feedback resistor R16 connected to the inverting input. Resistor R14 is connected through resistor R17 and also capacitor C11 to ground. The output of the operational amplifier 50 is connected to a pair of resistors R18, R19 and connected to the noninverting and inverting inputs of an operational amplifier 52, respectively. The circuit 52 is a self-biasing comparator which converts the analog output into a logic level as required by the processor means 30. A capacitor C12 is connected to the inverting input to ground. A resistor R20 is connected to the inverting input and to the identification means 32. The output operational amplifier 52 is connected to data input of the processor means 30. The operational amplifier 52 provides to the microcomputer 54 the data from the alert signal.

The identification means 32 includes a plurality of programmable jumpers 56 which may be cut to provide the desired house or system code. In the preferred embodiment, there are five jumpers 56 which are connected each to an input of the microcomputer 54. A cut jumper 56 will provide a bit code=0 designation while a connected jumper will provide a bit code=1 designation.

The processor means 30 includes a microcomputer 54 receiving the system code and the data signal. The format of the transmission must be correct for the microcomputer 54 to continue processing. In the preferred embodiment, all bit times are 10 msec. Logical symbols are differentiated by duty cycle. A logic 1 is designated by 262 msec pulse at the beginning of the 10 msec bit time. A logic 0 is designated by a 700 msec pulse at the beginning of the bit time. A sync bit is designated by a 4.65 msec pulse. Timing is provided by timing means 58 having a crystal controlled oscillator X1 connected to the microcomputer 54.

The processor means 30 also includes reset means 60 providing a reset input to microcomputer 54. The reset means 60 resets the microcomputer 54 if the power supply voltage drops below a predetermined voltage, i.e., 4 volt. This prevents the microcomputer 54 from locking up during a brown out. The reset means 60 includes a transistor Q2 having its emitter connected to the dc voltage supply and a base controlled by a pair of resistors R22, R23 connected to the power. A zener diode D6 is connected to the juncture of resistors R23, R22 and through resistor R24 to ground. The collector is connected through resistor R25 to ground. The collector is also connected to parallel diode D7 and resistor R26, and in turn through capacitor C13 to ground. A signal is produced which resets the microcomputer in case of brown out.

In operation, the microcomputer 54 upon receiving an alert data signal, compares the identification code with the system code. If the codes are equal, the processing continues. If the codes are unequal, further functions will not be formed. Assuming that the codes are equal, the microcomputer 54 compares the audio code to stored song assignment for a selection of the song assignment in memory 31. As long as the audio code matches one of the song assignment, the microcomputer 54 produces an audio signal representing the tones or melody by being played to the synthesizer means 34.

The synthesizer means 34 forms a simple synthesizer with selectable tone frequency, attack, and delay. A speaker 62 is driven using a transformer T1. An attack signal is produced from the microcomputer 54 through a resistor R30 to the base of the transistor Q3 having its emitter grounded. The collector drives a collector resistor R31 to a resistor R32 to inverting input of an operational amplifier 64. A decay signal is produced through resistor R34 from the microcomputer 54 to the base of the transistor Q4 having its collector connected to the voltage and its emitter connected through resistor R35 to resistor R32. A parallel resistor R36 is connected across the Q4/R35 combination. A parallel capacitor C15 is connected between the resistor R32 and ground (VSS). The operational amplifier has its noninverting input connected through resistor R37 to the voltage source and the resistor R38 to ground. The output of the operational amplifier 64 is connected through resistor R40 to transistor Q5. Feedback for the operational amplifier 64 is provided through resistor R41 to the inverting input. The audio signal is produced from the microcomputer through resistor R42 to the base of transistor Q6 having its emitter grounded with its collector connected to the emitter of transistor Q5. The collector of transistor Q5 drives the transformer T1 having a parallel capacitor C16, in turn driving the speaker 62. A resistor R43 supplies VCC 2 power to the transformer T1.

The detector means 12 may comprise one of three types of detector means, namely, entrance detector means 12, door bell detector means 12′, and chime detector means 12″. The entrance detector means 12 generally detects the opening of the door for transmission of the alert signal to provide audible indication thereof. With respect to the door bell detector means 12′, this is utilized in replacement of a standard door bell to allow transmission upon depression of the door bell. With regard to the chime detector means 12″ this is used in parallel with the existing door bell and wiring to provide additional audible indication. Each will be subsequently described. However, each includes the general means 16–26 as previously described.

The entrance detector means 12 is generally shown in FIG. 2. The condition sensing means 16 comprises a magnetic single pole single throw, reed switch 70 which is normally closed in the nonalerting position. Any type of magnetic switch as commonly known in the art of security systems may be utilized to provide a signal or transmission of the alert signal. The magnetic reed switch 70 is normally closed, and is opened in response to separation from a magnetic 72 fixedly located on the wall. The detector means 12 is generally connected to a door 68 whereupon separation or opening of the door 68 from the wall or structure 69, the magnet 72 is separated from the switch 70 thereby establishing the sensed condition. It is to be understood that the components positions may be reversed, i.e., connections to the door/wall. The reed switch 70 is connected to a battery 74. A resistor R50 is connected to the switch 70 and ground, and is connected to capacitor C20 through resistor R51 to the base of the transistor Q8. A resistor R52 is connected between the base and the emitter. The transistor Q8 provides a condition signal to the setting means 24. The setting means 24 includes a microcomputer 76 for receiving the condition signal and for providing the alert signal. The microcomputer 76 is connected to the plurality of identification coding means 26 which comprises a plurality of cutable jumper cables 78 which will set the identification code, equivalent to the system code set in the audio means 14. Furthermore, the manual activation means 22 comprises a push button switch which is connected to the microcomputer 76. The push button switch 22 is connected to the reset input of the microcomputer 76, as well as providing a signal through diode D10 connected to power, and a capacitor C22 to ground. The microcomputer 76 includes a timing circuit 80 comprising a crystal controlled oscillator X2 connected to the microcomputer 76. The microcomputer 76 produces the alert signal at an output thereof to the transmitter means 18. The transmitter means 18 is a clapp oscillator which converts the digital information conveyed by the microcomputer 76 into radio frequency pulses for transmission. The transmitter means 18 receives the alert signal through resistor R53 to the base of transistor Q9 and also connected through resistor R54 to ground. The emitter of the transistor Q9 is connected to ground through parallel resistor R55 and capacitor C23. The base is also connected through capacitor C24 to the transmitting coil circuit 82. The collector of the transistor Q9 drives the coil 82, which also has a parallel capacitor C25. The driving coil is also connected to a choke 83 to an antenna 86. The antenna 86 is also connected to power and through germanium diode D11 to the microcomputer 76.

In operation, the microcomputer 76, upon detection of the condition, obtains the coding of the identification code and the stored audio code and formats same for transmission through the transmitter means 18. The plurality of audio codes available are stored in code memory 77. With regard to setting the audio code, the push button switch 22 in combination with the microcomputer 76 is capable of scrolling through each possible melody or tone stored in the audio means 14. When power is first applied, the audio code is initialized to a preset value, such as 1. Each time the push button 22 is actuated, the code in the microcomputer 76 is incremented, i.e., 1 to 2, thus selecting next available audio code or audible indication. Each time a new code is set or selected, the microcomputer 76 transmits an alert signal to the audio means 14, and the audio means 14 plays the selection. This provides feedback to the user by indicating the sound or song just selected. Once a selection has been made, if no further selections are made the memory 77 in the microcomputer 76 will retain the audio code as the current code unless power is completely discontinued.

Figure 4:
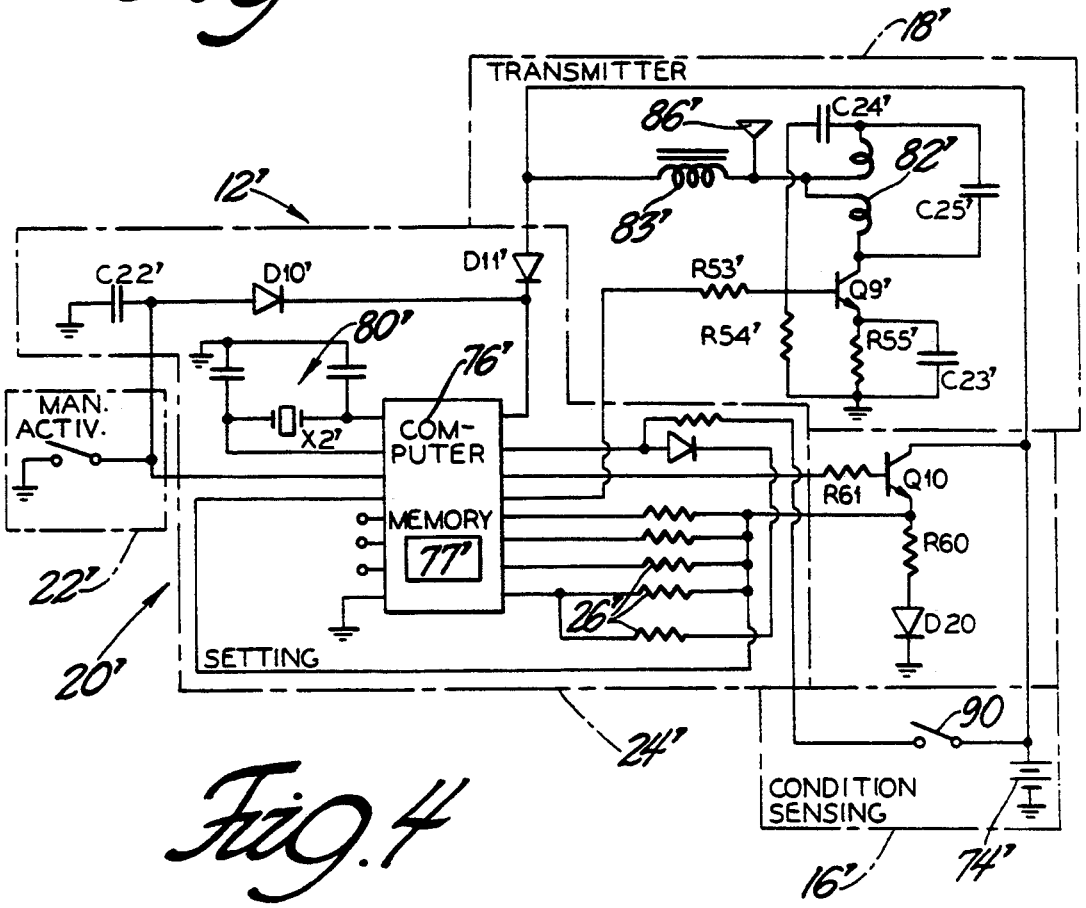
FIG. 4 is a schematic diagram of the door bell detector means.

The second type of detector means 12' is generally illustrated in FIG. 4. In this embodiment, the detector means 12' is utilized as a replacement to an existing door bell unit. Therefore, depression of a switch 90, acting as the door bell, presents the predefined condition. Similar components are utilized in the subject embodiment as those in the first embodiment 12, and includes primed reference numerals where the components are similar. Differences will be described. The condition sensing means 16 comprises the switch 90 for detecting depression thereof, such as with a door bell. A transistor Q10 is connected with the collector connected to the battery 74' with emitter connected through resistor R60 and LED D20. The base is connected through resistor R61 to the microcomputer 76'. This produces the condition signal to the microcomputer 76' of the audible selection means 20'. The audible selection means 20' and transmitter means 18' and coding means 26' are configured as in the first embodiment 12. The scrolling function along with remaining functions are as in the previous embodiment. Therefore, if it is desirable to obtain different types of musical sounds or melodies, the entire door bell actuator, i.e., push switch, may be replaced by the second embodiment detector means 12 where upon depression of the switch 90 will act as a predefined condition and cause the audio means 14 to produce the audible indication according to the audio code.

Figure 5:
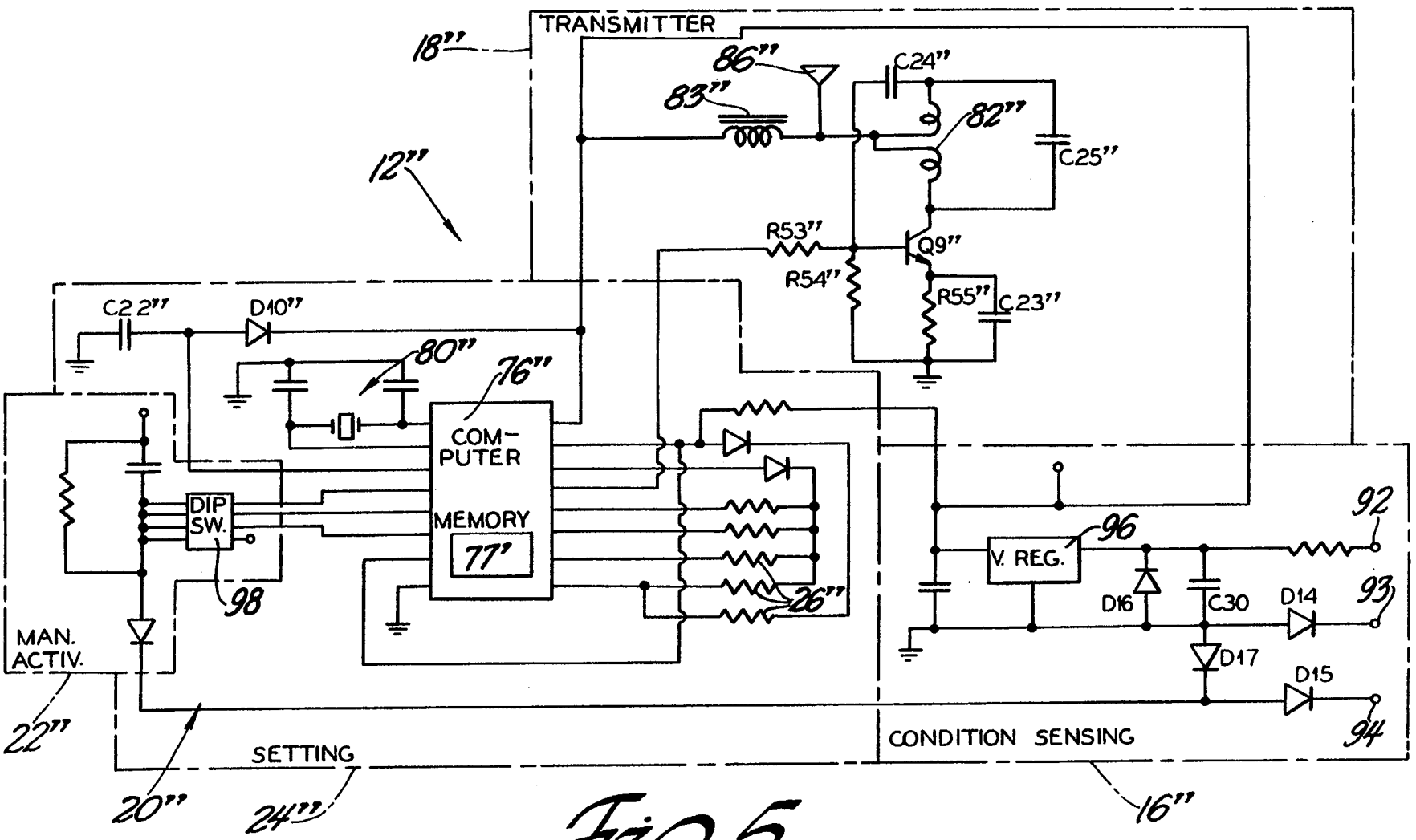
FIG. 5 is a schematic diagram of chime detector means.

The third embodiment of the detector means 12" is utilized in addition to an existing door bell circuit whereupon the detector means 12" is connected in parallel with the signal wires. The condition sensing means 16" comprises three leads 92, 93, 94 connected to the existing door bell wires as illustrated in FIG. 5. The first lead 92 is connected to the existing door bell transformer 99, the second lead 93 is connected to the front door signal line from the door bell, and the third lead 94 is connected to the rear or second door signal line from the door bell.

The condition sensing means 16" then provides the condition signal to the microcomputer 76". A difference in this embodiment is that a battery is not utilized, instead power is received from the wires themselves. A voltage regulator 96 is connected in series with the power or transformer wire 92 to .provide an adequate supply of power to the remainder circuitry. Diodes D14, D15 are connected to leads 93, 94. A parallel capacitor C30 and diode D16 are connected across the leads 92, 93 and diode D17 across leads 93, 94. The condition signal is received. The setting means 24" is substantially similar as those in the previous embodiments. The manual activation means 22" differs in that a four position dipswitch 98 is utilized to set the audio code, due to the fact that power is discontinued to the detector means 12 when there is no depression of the door bell. Therefore, the dipswitch 98 sets the audio code and the microcomputer 76 reads the code every time for transmission. The dipswitch 98 may be set manually by the user at any time. When the front door is depressed activating lead 93, the audio code is selected using the dipswitch 98. When the rear door is depressed activating lead 94, the pins of the dipswitch 98 are grounded by diode D17 which causes the audio code to be set at code=0 or the first audio code. This embodiment will not include the scrolling function due to the lack of power supplied thereto when the door bell is not depressed. The transmission means 18" is the same as in the previous embodiments.

It is to be understood that other types of detector means 12 may be used to sense different occurring conditions, such as telephone ringing, etc., as may be commonly known in the art and transmits similar signals to the audio means 14.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An alerting assembly for producing an audible indication of predefined conditions, said assembly comprising:

detector means (12) for detecting a predefined condition and for producing and transmitting a radio frequency alert signal indicative of said predefined condition;

audio means (14) remote from said detector means (12) for receiving said radio frequency alert signal and for producing one of several audible indications representative of the detection of said predefined condition;

said detector means (12) including audible selection means (20) for manual selection of one of a plurality of audio codes representative of different audible indications and radio frequency transmitter means (18) for receiving and transmitting said radio frequency alert signal comprising said selected audio code upon detection of said predefined condition to said audio means (14), said audio means (14) producing said one of several audible indications based on said selected audio code.

2. An assembly as set forth in claim 1 further characterized by said audio means (14) including decoding means (8) for receiving said radio frequency alert signal to determine said audio code and for comparing said audio code to a plurality of stored codes to obtain a selected tone or melody for the audible indication.

3. An assembly as set forth in claim 2 further characterized by said audio means (14) including processor means (30) for receiving said selected tone or melody and for producing said audible indication based on the selected tone or melody.

4. An assembly as set forth in claim 1 further characterized by said audio means (14) including identification means (32) for manual selection of a predetermined system code for identifying associated detector means (12).

5. An assembly as set forth in claim 4 further characterized by said detector means (12) including identification coding means (26) subject to manual actuation coding of an identification code equivalent to said system code of said audio means (14).

6. An assembly as set forth in claim 2 wherein said audio means (14) includes memory means (31) for storing a plurality of melody and tone format signals with a code identified therewith for comparison with said alert signal to produce the selected audio indication.

7. An assembly as set forth in claim 1 wherein said audible selection means (20) includes a manual switch for setting of said audio code upon actuation thereof.

8. An assembly as set forth in claim 7 wherein said audible selection means (20) includes setting means (24) for sequentially scrolling through each of said audible codes upon sequential activation of said manual switch.

9. An assembly as set forth in claim 7 wherein said audible selection means (20) includes a plurality of manual switches having two conditions each for a portion of said audio code based on the position of each switch.

10. An assembly as set forth in claim 1 wherein said detector means (12) includes setting means (24) for producing said alert signal upon each change of selection of said audio code for transmission of said alert signal.

11. An assembly as set forth in claim 7 wherein said detector means (12) includes setting means (24) for producing said alert signal upon each change of selection of said audio code for transmission of said alert signal.

12. An alerting assembly for producing audible indication of predefined conditions, said assembly comprising:

detector means (12) for detecting a predefined condition and for producing and transmitting a radio frequency alert signal;

audio means (14) remote from said detector means (12) for receiving said radio frequency alert signal and for producing one of several audible indications representative of the detection of said predefined condition;

said detector means (12) including selection means (20) for selecting one of a plurality of audio codes for transmission in said radio frequency alert signal, said audio means (14) producing said one of several audible indications based on the selected audio code.

13. An assembly as set forth in claim 12 further characterized by said detector means (12) including identification coding means (26) for allowing manual actuation and coding of an identification code transmitted as part of said alert signal.

14. An assembly as set forth in claim 13 further characterized by said audio means for manual selection of a system code equivalent to said identification code.

15. An assembly as set forth in claim 14 further characterized by said audio means (14) including processor means for receiving said audio code and said identification code and comparing said identification code to said system code, and upon a match, decoding said audio code and producing the audible indication selected by said audio code.

16. An assembly as set forth in claim 12 further characterized by said audio means (14) including processor means (30) for receiving said alert signal including said audio code for producing the selected audible indication represented by said audio code.

17. An assembly as set forth in claim 16 further characterized by said selection means (20) including setting means (24) for producing said audio code and transmitting said alert signal upon each change in selection of between said plurality of audio indications.

18. A method of producing audible indications indicative of predefined conditions, the method including the steps:

detecting a predefined condition;

producing and transmitting a radio frequency alert signal indicative of the predefined condition;

manually selecting one of a plurality of audio codes representative of different audible indications for association with the predefined condition and for transmission of a selected audio code in said alert signal;

transmitting the selected audio code upon detection of the predefined condition;

remotely receiving the radio frequency alert signal with audio code and producing one of several audible indications representative of the detection of the predefined condition.

19. A method as set forth in claim 18 further including storing a plurality of codes and receiving the alert signal to compare the audio code with the stored codes to obtain a selected tone or melody for audible indication.

20. A method as set forth in claim 19 further including transmitting an identification code with the alert signal, and receiving the identification code with the alert signal and comparing the identification code with a stored system code to verify association.

21. A method as set forth in claim 18 further including establishing the audio code by manual actuation selecting one of the audio codes.

22. A method as set forth in claim 21 further including scrolling through each of the audible codes upon sequential activation and causing transmission of the audio code upon each selection of audible codes.

23. An alerting assembly for producing an audible indication of predefined conditions, said assembly comprising:

detector means (12) for detecting a predefined condition and for producing and transmitting an alert signal indicative thereof:

audio means (14) for receiving said alert signal and for producing one of several audible indications representative of the detection of said predefined conditions;

said detector means (12) including audible selection means (20) for manual selection of one of a plurality of audio codes representative of different audible indications and transmitter means (18) for receiving and transmitting said selected audio code upon detection of said predefined condition to said audio means (14); and audio means (14) including identification means (32) for manual selection of a predetermined system code for identifying associated detector means (12).

24. An assembly as set forth in claim 23 further characterized by said alert signal comprising a radio frequency signal with said audio code identified therein.

25. An assembly as set forth in claim 24 further characterized by said detector means (12) including identification coding means (26) subject to manual actuation for coding of an identification code equivalent to said system code of said audio means (14).

26. An assembly as set forth in claim 23 wherein said audible selection means (20) includes a manual switch for setting of said audio code.

27. An assembly as set forth in claim 26 wherein said audible selection means (20) includes setting means (24) for scrolling through each of said audible codes upon sequential activation of said manual switch.

28. An alerting assembly for producing audible indication of predefined conditions, said assembly comprising:

detector means (12) for detecting a predefined condition and for producing and transmitting an alert signal;

audio means (14) for receiving said alert signal and for producing one of several audible indications representable of the detection of said predefined conditions;

said detector means (12) including selection means (20) for selecting one of a plurality of audio codes representative of different audible indication for transmission in said alert signal; and said detector means (12) including identification coding means (26) for allowing manual actuation and coding of an identification code transmitted as part of said alert signal.

29. An assembly as set forth in claim 28 further characterized by said audio means for manual selection of a system code equivalent to said identification code.

30. An assembly as set forth in claim 14 further characterized by said audio means (14) including processor means for receiving said audio code and said identification code and comparing said identification code to said system code, and upon a match, decoding said audio code and producing the audible identification selected by said audio code.

31. A method producing audible indication indicative of predefined conditions, the method including the steps of:

detecting a predefined condition;

producing and transmitting an alert signal indicative of the predefined condition;

receiving the alert signal and producing one of several audible indication representative of the detection of the predefined condition;

manually selecting one of a plurality of audio codes representative of different audible indications;

receiving and transmitting the selected audio code upon detection of the predefined condition;

transmitting an identification code with the alert signal;

and receiving the identification code with the alert signal and comparing the identification code with a system code to verify by association with the system.

* * * * *